United States Patent [19]

Weber

[11] 4,403,591

[45] Sep. 13, 1983

[54] IGNITION SYSTEM HAVING VARIABLE PERCENTAGE CURRENT LIMITING

[75] Inventor: Howard F. Weber, Scottsdale, Ariz.

[73] Assignee: Motorola, Inc., Schaumburg, Ill.

[21] Appl. No.: 253,770

[22] Filed: Apr. 13, 1981

[51] Int. Cl.[3] ..... F02P 9/00

[52] U.S. Cl. ..... 123/609; 123/644

[58] Field of Search ..... 123/609, 610, 611, 644

[56] References Cited

U.S. PATENT DOCUMENTS

| | | | |
|---|---|---|---|
| 4,008,698 | 2/1977 | Gartner | 123/611 |
| 4,043,302 | 8/1977 | Sessions | 123/609 |
| 4,117,819 | 10/1978 | Jarrett et al. | 123/609 |
| 4,170,209 | 10/1979 | Petrie et al. | 123/609 |
| 4,176,645 | 12/1979 | Jundt et al. | 123/609 |

*Primary Examiner*—Charles J. Myhre
*Assistant Examiner*—Andrew M. Dolinar
*Attorney, Agent, or Firm*—Michael D. Bingham

[57] ABSTRACT

An ignition system which is responsive to timing signals generated in timed relationship to the operation of an internal combustion engine for providing firing spark to operate the engine. The system uses two capacitors to provide an adaptive dwell system wherein the percent of time that ignition coil current is limited at a fixed magnitude is made variable with respect to the engine rpm.

9 Claims, 4 Drawing Figures

IGNITION SYSTEM HAVING VARIABLE PERCENTAGE CURRENT LIMITING

CROSS REFERENCE TO RELATED APPLICATION

The subject matter of this application is related to the subject matter of patent application Ser. No. 253,423, "START-TO-RUN CIRCUIT FOR AN ELECTRONIC IGNITION SYSTEM" now U.S. Pat. No. 4,379,444 filed concurrently herewith which is assigned to Motorola, Inc.

BACKGROUND OF THE INVENTION

1. Field of the Invention

This invention relates to internal combustion engine ignition systems and, more particularly, to a solid state ignition system having a variable percent current limiting time for improved acceleration performance.

2. Description of the Prior Art

The art is replete with ignition systems for providing firing spark to internal combustion engines and which linearly vary the dwell time of the ignition firing cycle. For example, U.S. Pat. No. 4,041,912 describes such an ignition system wherein the dwell time of the ignition system is linearly regulated to provide fired current-limiting (excess dwell current) time of the coil energizing current with respect to the total firing cycle period of the internal combustion engine.

One of the concerns with present day ignition systems is that the systems operated under high or rapid acceleration rates. The present invention provides a method of regulating the coil current-limit time to a variable percentage of the firing cycle to provide better acceleration performance. Additionally, some prior art ignition systems of the same type as herein described require a minimum of four discrete capacitors to provide adaptive dwell and start dwell control. Thus, a need exists for minimizing the number of capacitors required for operation of these ignition systems.

SUMMARY OF THE INVENTION

Thus, it is an object of the present invention to provide an improved solid state ignition system for internal combustion engines.

Another object of the invention to provide an ignition system having variable percent current limit time as a function of the total time period of an individual firing cycle of the internal combustion engine.

Still another object of the invention is to provide an ignition system requiring only a pair of discrete capacitors for operation in a run mode.

In accordance with the above and other objects, there is provided an ignition system for an internal combustion engine wherein the percent of current limiting time prior to firing in the engine in a particular firing cycle is made variable with engine rpm. The system includes a first circuit which is responsive to each successive ignition timing signal generated from the internal combustion engine for producing both a control signal having dual constant slopes of opposite polarity and magnitude and a monopulse output signal; a threshold circuit responsive to the first circuit for generating a threshold signal having a variable magnitude, and a second circuit for producing first and second switching signals with the second switching signal occurring when the magnitude of the second one of the dual slopes reaches a predetermined value with respect to the magnitude of the threshold signal and the second switching signal occurring only during the interval of the monopulse such that an amplifier is rendered conductive in response to the second switching signal for producing a charging current through an ignition coil and is responsive to the second switching signal for causing discharge of the ignition coil; a feedback circuit is provided which is responsive to the current through the switching amplifier reaching a predetermined magnitude for limiting the current thereat as well enabling the threshold circuit to cause the magnitude of the threshold signal to be varied in accordance to the period during which the current is limited such that as the engine rpm varies the percentage of time that the current through the amplifier is caused to be limited is varied.

DETAILED DESCRIPTION OF THE PREFERRED EMBODIMENT

Figure 1:
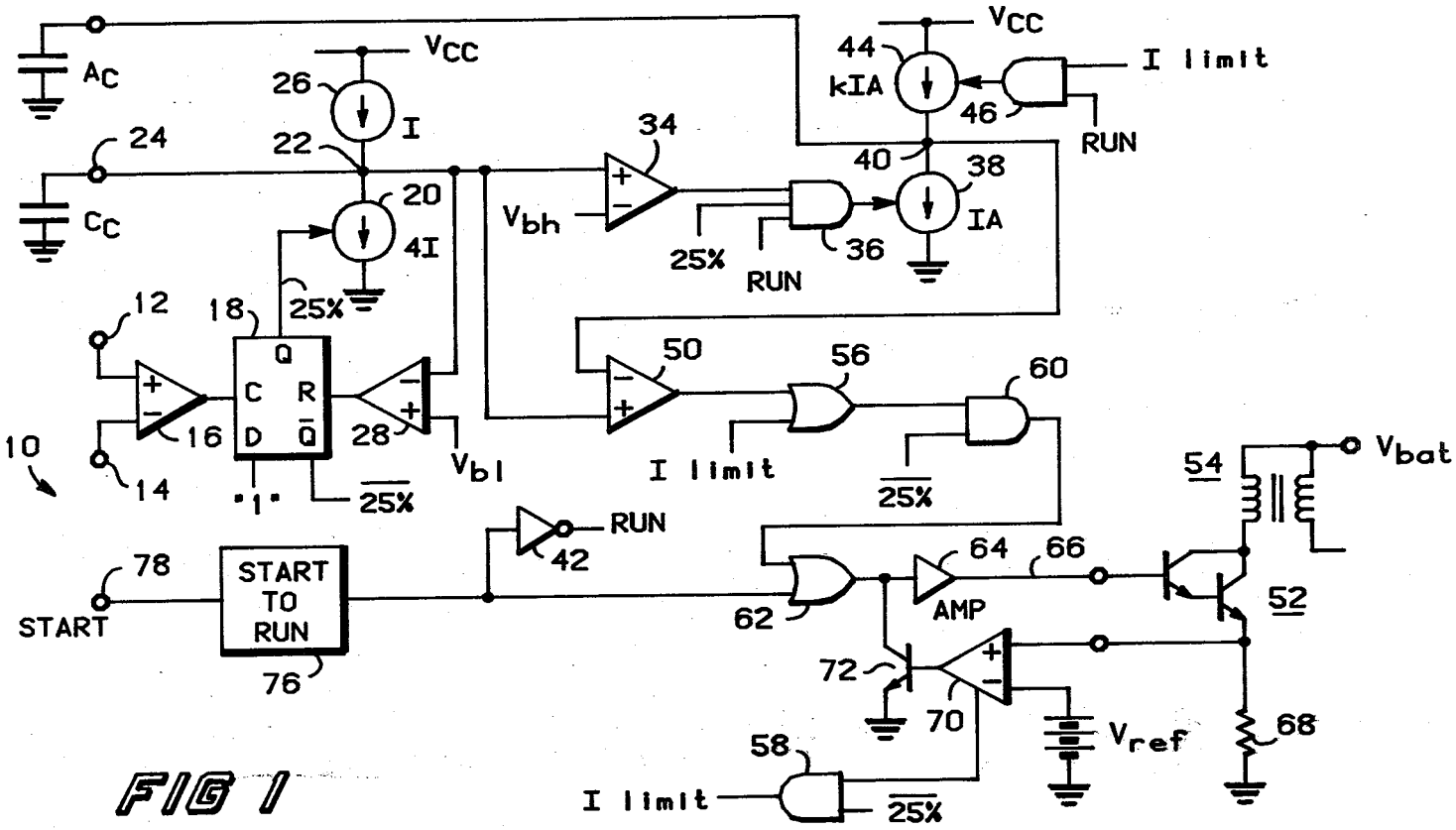
FIG. 1 is a partial block and schematic diagram illustrating a solid state ignition system of the present invention.
Figure 2:
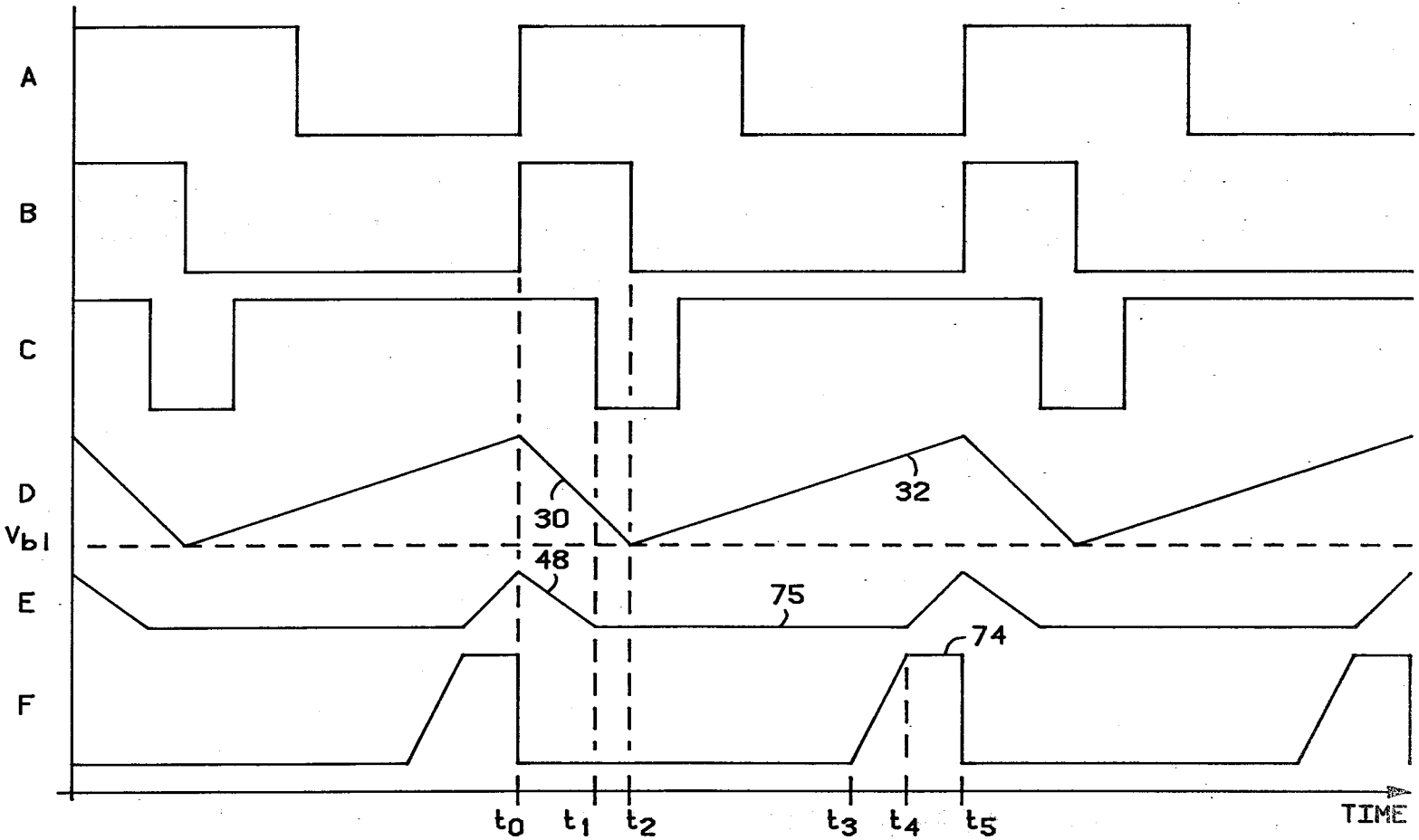
FIG. 2 illustrates waveforms useful in understanding the operation of the embodiment shown in FIG. 1.

Turning to FIGS. 1 and 2 there is shown and described ignition system 10 of the present invention which is responsive to ignition timing signals generated in time relationship to an internal combustion engine for controlling the charging and discharging of the ignition coil of the engine system. Ignition timing signals having generally a sinusoidal shape with positive and negative portions are produced in time relationship with the engine in a well known manner. These timing signals are differentially applied to a first circuit at input terminals 12 and 14 of differential comparator 16 which has hysteresis associated therewith. The output signal from comparator 16, which is applied to the C input terminal of D-type flip-flop 18, is of general square wave shape as shown in waveform FIG. 2A. The Q output terminal of flip-flop 18 is applied to a control input of current source 20 to render the current source conductive in response to the Q logic signal designated as the 25% signal. Current source 20 is coupled between node 22 and a source of ground reference potential to a capacitor $C_C$ at node 24. A second current source 26 is shown coupled between a source of operating potential $V_{CC}$ and node 22; node 22 is returned via a lead line to the inverting input of differential comparator amplifier 28. The non-inverting input of differential comparator 28 is coupled to a reference potential $V_{b1}$ with the output of the comparator being returned to a reset input terminal of D-type flip-flop 18. Assuming the ignition system is in a run mode, in response to the particular timing signal crossing the zero axis in a positive direction (time $t_0$), a logic one signal is produced at the Q output of flip-flop 18 to render current source 20 conductive. Current source 20 provides a current of magnitude 4I which therefore sinks all of the current I provided from current source 26. Hence, capacitor $C_C$ is discharged at a rate proportional to the current magnitude of 3I as shown by portion 30 of waveform 2D. Capacitor $C_C$ is discharged by current source 20 until such time that the potential thereacross decreases below the reference potential $V_{b1}$ which produces an output signal from differential comparator 28 to reset flip-flop 18. Thereafter, the Q output signal from flip-flop 18 goes to zero at time t2 (waveform 2B). As the Q output of flip-flop 18 goes to zero current source 22 is rendered non-conductive to allow capacitor $C_C$ to charge at a rate proportional to the current I from current source 26 (portion 32 of waveform 20). Hence, a monopulse output signal occurs at the Q output of flip-flop 18 during the initial time period of each firing cycle which lasts for approximately 25 percent of the total firing cycle. During the remainder of the firing cycle, the $\overline{Q}$ output terminal of flip-flop 18 goes to a logic one as noted by the $\overline{25\%}$ output signal shown in FIG. 1.

A second or threshold signal producing circuit is shown comprising differential comparator 24 the non-inverting input of which is coupled to node 22 to capacitor $C_C$ and the inverting input being coupled to a second bias potential $V_{bh}$. The output of differential comparator 34 is coupled to a first input of logic circuit 37 comprising AND gate 36. The output of AND gate 36 controls the conduction of current source 38 which is coupled between node 40 and ground reference potential. A second input of NAND gate 36 is coupled to the Q output of flip-flop 18 with a thick input being coupled to the output of inverter 42. The input of inverter 42 is coupled to the output of a start-to-run circuit which as will be more fully explained, causes the output of inverter 42 to be at a logic one state whenever the engine and the ignition system are in a run mode. Controlled current source 44 is coupled between a source of operating potential and node 40 and is rendered conductive or non-conductive by the logic output signal from AND gate 46. As will be later explained, at the initiation of each firing cycle, the potential across capacitor $C_C$ is at an upper peak magnitude and an output signal is produced at the output of differential comparator 34 to enable AND gate 36 until such time that the capacitor is discharged to the reference potential $V_{bh}$ as shown by waveform 2C. Thereafter, the output from comparator 34 goes low to disable AND gate 36 to cause the output therefrom to go to a zero. Thus, during $t_0$-$t_1$ all of the inputs to NAND gate 36 are at a logic one state such that current source 38 is rendered conductive to discharge capacitor $A_C$, which is coupled to node 40, at a rate proportional to current $I_A$ as shown by portion 48 of waveform 2E. Capacitor $A_C$ will be discharged until $t_1$, when the output of differential comparator 34 goes to a zero. The threshold signal, waveform 2E, is held at a substantially constant magnitude from time $t_1$-$t_2$ for a period of 625 microseconds for instance and thereafter if the firing cycle period is greater than this 625 microsecond constant time until near the end of the firing cycle after which capacitor $A_C$ is charged at a constant ramp rate proportional to the current supplied by current source 44 as will be later explained. Hence, in response to initiation of each firing cycle, the adaptive dwell capacitor is discharged for a predetermined percentage minus a constant period, i.e., 25%–625 microseconds in the preferred embodiment.

A third circuit comprising comparator 50 produces first and second switching signals for first rendering switching amplifier 52 conductive and then non-conductive to charge and then discharge ignition coil 54 to produce firing spark to the engine. The non-inverting input of differential comparator 50 is coupled to capacitor $C_C$ with the inverting input thereof being coupled to capacitor $A_C$. The output of comparator 60 is coupled to a first input of OR gate 56. A second input of OR gate 56 is coupled to an output of AND gate 58 to receive a logic input signal designated I limit. The output of OR 56 is connected to a first input of AND gate 60 which has its output connected to an input of OR gate 62. A second input of AND gate 60 is coupled to the $\overline{Q}$ or $\overline{25\%}$ logic signal from flip-flop 18. The output of OR gate 62 drives an input of drive amplifier 64 which provides drive current to switching amplifier 52 via lead 66.

In operation, with the engine running, during the first 25% of the firing period, the $\overline{Q}$ output of flip-flop 18 is in a low state such that the output of AND gate 60 is at a logic zero state. Thus, amplifier 64 is maintained in a non-conductive state and switching amplifier 52 cannot be rendered conductive during the first 25% interval of the firing cycle, i.e., between time interval $t_0$-$t_2$. In fact, amplifier 64 is maintained non-conductive until such time that the capacitor $C_C$ is charged to a magnitude greater than the magnitude of the threshold signal which appears across capacitor $A_C$ at which time an output signal from comparator 50 and OR gate 56 produces a logic one signal to the input of AND gate 60. If the engine is operating in the last 75% interval of the firing cycle, both inputs to AND gate 60 will be at a logic one level such that a logic one is produced at the output thereof and via OR gate 62 to render amplifier 64 conductive. Therefore, at time $t_3$ switching amplifier 52 is rendered conductive to cause a dwell current to flow to charge coil 54 as shown by waveform 2F, during $t_3$-$t_4$. Current thus flows through resistor 68 which increases at the rate that coil 54 is charged until time $t_4$ when the magnitude of voltage thereacross exceeds the reference potential $V_{ref}$ supplied at the inverting input of comparator 70. Between time $t_4$-$t_5$, the current through switching amplifier 52 is linearly limited by the feedback signal from comparator 70 rendering transistor 72 conductive in a linear manner to reduce the drive through amplifier 64 (portion 74 of waveform 2F). Simultaneously with current limiting, a logic one output is produced from comparator 70 to an input of AND gate 58 which, in conjunction with the engine operating in the last 75% of the firing cycle, produces the logic signal I limit at the output thereof. Finally, a firing cycle is completed by the next successive ignition timing signal crossing the zero axis in a positive direction which causes the output of AND gate 60 to go to a logic zero turning the switching amplifier off causing discharge of the ignition coil.

With the engine operating in a steady-state condition, i.e., neither being accelerated or decelerated, adaptive dwell capacitor $A_C$ is first discharged at a rate proportional to the current through current source 38 during the first twenty-five percent of the firing cycle period minus the 625 microseconds time period of the particular firing cycle, $t_1$-$t_2$. Thereafter, with both current source 38 and 44 being in a non-conductive state the magnitude of the potential across the capacitor is maintained constant between time intervals $t_2$ to $t_4$. At time $t_4$, in response to the logic signal, $I_{limit}$, current source 44 is rendered conductive to charge capacitor $A_C$ at a rate K times the rate that was discharged. Hence, as the excess dwell time (the current limit time) increases or decreases, capacitor $A_C$ is either charged to a higher or lesser level which in turn either increases or decreases the potential level at which the capacitor is maintained (portion 75 of waveform 2E). Therefore, as the magnitude of the threshold signal is varied due to the foregoing, the time during the firing cycle, $t_3$, at which the magnitude of the potential across capacitor $C_C$ becomes equal to the magnitude of the threshold signal is also varied which in turn varies the time during the firing cycle that the switching amplifier is rendered conductive whereby the percentage of time current-limiting occurs is varied.

Start-to-run circuit 76 is shown having an input coupled to a start terminal 78 and an output coupled to both the input of inverter 42 and to a second input of OR gate 62. In response to the starting of the internal combustion engine, a start signal is produced at terminal 78 to produce a logic one at the output of start-to-run circuit 76. Hence, during starting of the engine, amplifier 64 charges coil 54 to provide start firing spark as is understood. During normal engine run conditions, the output from start-to-run circuit 76 is zero, thereby producing a logic one at the output of inverter 42 as previously discussed. For a more detailed discussion of a start-to-run circuit suitable to be utilized in the present invention copending application Ser. No. 253,423 now U.S. Pat. No. 4,379,444 is referred to, the teaching of which is herein incorporated by reference.

One novel aspect of the present invention is to cause the excess dwell period, i.e., the time that the switching amplifier is in a current-limited state to be reduced to a lower percentage of the total firing cycle at higher engine rpm when compared to the same period during lower engine rpm.

At lower engine rpm the 625 microsecond constant time interval ($t_1$-$t_2$) during which the magnitude of potential across capacitor $A_C$ is held constant is relatively insignificant when compared to the total firing cycle period ($t_0$-$t_5$). Hence, at the lower engine rpm, the percent of time that current limiting or excess dwell period occurs is relatively a fixed percentage of the firing cycle period. Nominally, the percentage of time that the switching amplifier is in a current-limited state is approximately equal to 20% of the overall firing cycle. However, at higher engine rpm this percentage is reduced to between 15 and 10% or less of the total firing cycle. This lower percentage of excess dwell time occurs because at higher engine rpm the 625 microsecond period becomes a significant portion of the first 25% of the firing cycle period such that the magnitude of the threshold voltage is made to substantially increased with respect to the discharge and charge of the control capacitor $C_C$ whereby the time ($t_3$) at which the ignition coil begins ramping occurs later in the firing cycle and therefore a lower percentage of current limit time occurs therein.

Another novel aspect of the present invention is that the control capacitor $C_C$ controls the function of three different circuits, i.e., a monopulse is produced by proportional charging and discharging of capacitor $C_C$ during the first 25% of each firing cycle; a 625 microsecond delay period is produced during the discharge of the capacitor at which the adaptive dwell capacitor $A_C$ is allowed to discharge; and a switching signal is generated therefrom for initiating dwell current. Some prior art ignition systems have required the utilization of three separate capacitors to provide the functions derived from the single aforementioned capacitor. Hence, the ignition system eliminates the need for multiple, relatively expensive capacitors, to be used in controlling the percent dwell time of the ignition system.

Although the above description refers to discharging the adaptive dwell capacitor, $A_C$, during the first twenty-five percent of the firing cycle period minus a constant time interval it should be understood that a variable percent current-limit drive could also be derived by allowing the capacitor to be discharged from $t_0$-$t_2$, then holding the potential thereacross substantially constant for a minimum delay period thereafter and then allowing the capacitor to be discharged during the remainder of the first fifty percent of the firing cycle. Thereafter, the potential across the dwell capacitor would be maintained substantially constant until current limiting occurs and the capacitor is charged as previously described.

Figure 3:
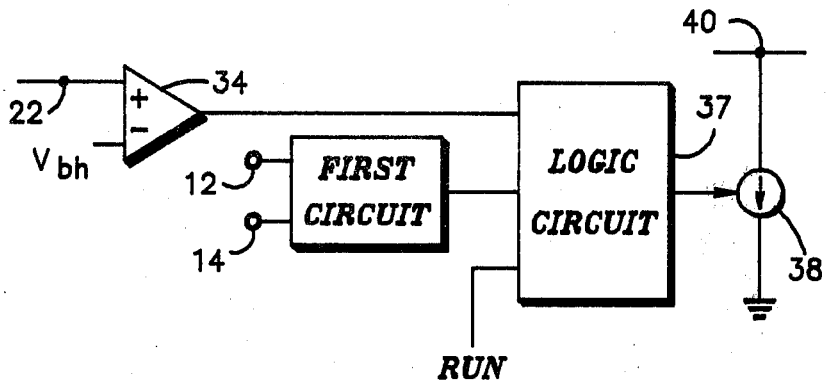
FIG. 3 is a partial schematic and block diagram illustrating a threshold circuit of an alternate embodiment of the ignition system of FIG. 1.
Figure 4:
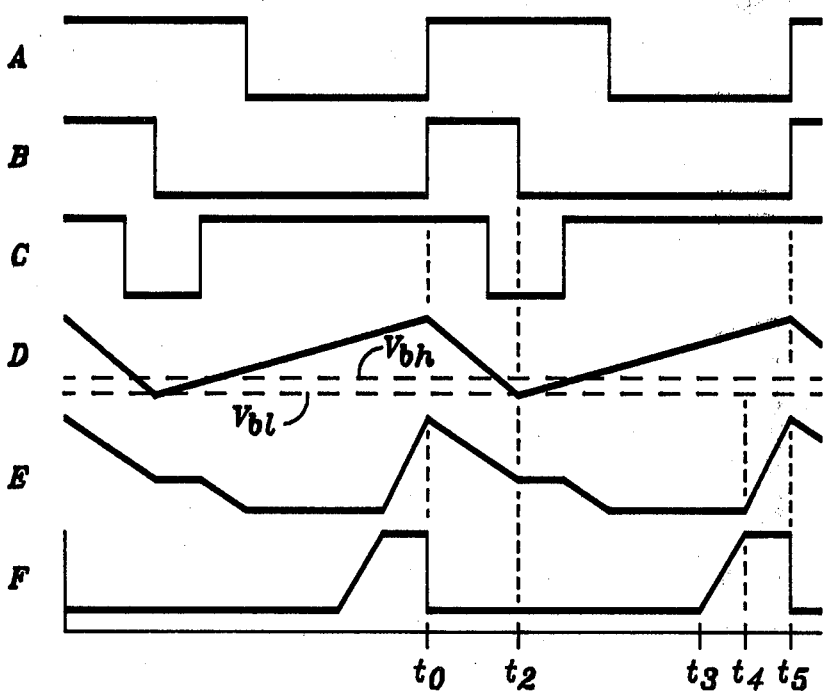
FIG. 4 is a waveform diagram illustrating the operation of the threshold circuit of FIG. 3.

As an example, referring to FIGS. 3 and 4, logic circuit 37 is responsive to the respective output signals generated at the outputs of comparator 34 and the previously mentioned first circuit to provide the above described function. Hence, waveforms 4A through 4D, which correspond to waveforms 2A through 2D, are generated as previously described in timed relationship to the ignition signals such that logic circuit 37 causes waveform 48 to be produced across adaptive capacitor AC which, as illustrated is discharged through the initial 50% interval of each firing cycle period minus a predetermined time during which the potential thereacross is maintained substantially constant. Thereafter, during the final 50% portion of the firing cycle, the potential across the adaptive dwell capacitor is held substantially constant until initiation of coil current (FIG. 4F) at time t3.

Thus, what has been aforedescribed is a novel ignition system for varying the percentage of excess dwell time at higher engine rpm and eliminating the need for multiple capacitors by using a single capacitor for providing three separate drive functions in conjunction with discharging another capacitor during a predetermined percentage of each initiated firing cycle period minus a constant time interval during which the potential thereacross is maintained constant.

I claim:

1. An adaptive dwell ignition system for engine control wherein the excess dwell current time during which the magnitude of current in an ignition coil is limited prior to discharge thereof is caused to be varied in response to variations in engine rpm, the ignition system which is responsive to the initiation of timing signals generated in timed relationship with the engine to charge and discharge the coil includes a threshold circuit for producing a variable threshold signal whereby the percent of excess dwell current time in each firing cycle period is varied, the improvement comprising the threshold circuit being responsive to the initiation of each firing cycle period for causing the magnitude of the threshold signal to be decreased at a first rate during a predetermined percent of the firing cycle period minus a predetermined constant time interval of said percent of firing cycle period during which interval the magnitude of the threshold signal is held constant, the threshold circuit maintaining said magnitude of the threshold signal substantially constant thereafter until current limiting occurs at which time the magnitude of the threshold signal is caused to be increased at a second rate until the coil is discharged.

2. The ignition system of claim 1 including:

amplifier means coupled with the ignition coil for charging the same when rendered conductive and allowing discharge thereof when rendered non-conductive;

feedback means responsive to the current reaching a predetermined magnitude for causing the same to be limited thereto by reducing the conductivity of said amplifier means;

first circuit means responsive to each successive ignition timing signal for producing a monopulse signal to render said amplifier means non-conductive for a first predetermined time interval thereafter and for producing an output signal having first and second slopes of opposite polarity and differing magnitude; and second circuit means responsive to the magnitude of said output signal from said first circuit means exceeding said magnitude of the threshold signal for rendering said amplifier means conductive.

3. The ignition system of claim 2 wherein said first circuit means includes:

first current source means for supplying current of a first magnitude to a first circuit node;

second current source means for sourcing current from said first circuit node of a second magnitude when rendered conductive;

input means responsive to each successive timing signal for rendering said second current source means conductive;

first charge storage means coupled to said first circuit node which is charged at a first constant rate by said first current source means and discharged at a second constant rate by said second current source means; and first comparator means responsive to said first charge storage means being discharged to a first predetermined potential for causing said input means to render said second current source means non-conductive.

4. The ignition system of claim 3 wherein the threshold circuit includes:

second comparator means responsive to said first charge storage means being discharged for supplying a control signal until said potential across said first charge storage means reaches a second predetermined level;

first logic circuit means responsive to said output pulse from said first circuit means and to said control signal from said second comparator means for providing a first logic control signal;

third current source means responsive to said first logic signal for sourcing current of a third magnitude from a second circuit node;

fourth current source means responsive to a second logic control signal for sourcing current of a fourth predetermined magnitude to said second circuit node;

second logic circuit means responsive to said current through the coil being limited to said predetermined magnitude for producing said second logic control signal; and second charge storage means coupled to said second circuit node, said second charge storage means being charged by said fourth current source means and discharged by said third current source means.

5. The ignition system of claim 4 wherein said second circuit means includes:

third comparator means having first and second inputs coupled to said first and second circuit nodes respectively for producing an output signal whenever the magnitude of the potential appearing at said first circuit node is greater than the magnitude of the potential appearing at said second circuit node; and third logic means responsive to said output signal from said third comparator for supplying a control signal for rendering the said amplifier means conductive.

6. The ignition system of claim 5 wherein said feedback means includes:

resistive means coupled to said amplifier means for producing a potential the magnitude of which varies with the magnitude of current flowing through the ignition coil; and comparator circuit means responsive to said potential across said resistive means exceeding a reference potential for linearly reducing the conductivity of said amplifier means until said current limiting occurs and for producing a logic signal to said second logic means during current limiting.

7. The ignition system of claim 1 wherein the magnitude of the threshold signal is first decreased at said first rate during the first twenty-five percent of each firing cycle period then maintained substantially constant for a fixed period of time thereafter.

8. The ignition system of claim 7 wherein the threshold circuit is responsive to the engine rpm being less than a predetermined rpm for decreasing the magnitude of the threshold signal at said first rate from termination of said fixed period of time until the end of the first fifty percent of each firing cycle and thereafter maintaining the magnitude constant until current limiting occurs.

9. The ignition system of claim 1 wherein the magnitude of the threshold signal is decreased at a first rate during a first portion of the first twenty-five percent of each firing cycle period and then maintained at a substantially constant level during the remainder portion of the twenty-five percent period.

* * * * *